US006469611B1

(12) United States Patent
Kluge-Weiss et al.

(10) Patent No.: US 6,469,611 B1
(45) Date of Patent: Oct. 22, 2002

(54) NON-LINEAR RESISTANCE WITH VARISTOR BEHAVIOR AND METHOD FOR THE PRODUCTION THEREOF

(75) Inventors: Petra Kluge-Weiss, Baden-Dättwil (CH); Felix Greuter, Baden-Rütihof (CH); Ralf Strümpler, Gebenstorf (CH)

(73) Assignee: ABB Research Ltd, Zurich (CH)

( * ) Notice: Subject to any disclaimer, the term of this patent is extended or adjusted under 35 U.S.C. 154(b) by 0 days.

(21) Appl. No.: 09/445,572

(22) PCT Filed: Apr. 23, 1999

(86) PCT No.: PCT/CH99/00165

§ 371 (c)(1),
(2), (4) Date: Dec. 9, 1999

(87) PCT Pub. No.: WO99/56290

PCT Pub. Date: Nov. 4, 1999

(30) Foreign Application Priority Data

Apr. 27, 1998 (DE) ..... 198 24 104

(51) Int. Cl.[7] ..... H01C 7/10
(52) U.S. Cl. ..... 338/20; 338/21
(58) Field of Search ..... 338/20, 21; 428/403

(56) References Cited

U.S. PATENT DOCUMENTS

| | | | | |
|---|---|---|---|---|
| 4,285,839 A | * | 8/1981 | Wong | 252/519 |
| 4,726,991 A | | 2/1988 | Hyatt et al. | |
| 4,992,333 A | | 2/1991 | Hyatt | |
| 5,068,634 A | | 11/1991 | Shrier | |
| 5,276,080 A | * | 1/1994 | Oku | 524/432 |
| 5,294,374 A | | 3/1994 | Martinez et al. | |
| 5,669,381 A | | 9/1997 | Hyatt | |
| 5,742,223 A | * | 4/1998 | Simendinger, III et al. | 338/21 |
| 6,124,549 A | * | 9/2000 | Kemp et al. | 174/73.1 |

FOREIGN PATENT DOCUMENTS

| | | |
|---|---|---|
| DE | 2363172 | 6/1975 |
| DE | 4221309 A1 | 1/1994 |
| DE | 4427161 A1 | 2/1996 |
| DE | 19509075 A1 | 9/1996 |
| WO | WO94/25966 | 11/1994 |
| WO | WO97/26693 | 7/1997 |
| WO | WO97/26693 | 10/1997 |

OTHER PUBLICATIONS

Reichenbach et al. New Low–Voltage Varistor Composites, v.31, pp 5941–44, J.Mat.Sci., 1996.*
"Smart Varistor Cumposites", Strumpler, et al., Proceedings of 8$^{th}$ CIMTEC–World Ceramic Congress and Forum on New Materials (Jun. 1994).

* cited by examiner

*Primary Examiner*—Karl D. Easthom
(74) *Attorney, Agent, or Firm*—Burns, Doane, Swecker & Mathis, L.L.P.

(57) ABSTRACT

The nonlinear resistor has varistor behaviour and has a matrix and a filler in powder form which is embedded in the matrix. The filler contains sintered varistor granules with predominantly spherical particles of doped metal oxide. These particles are made up of crystalline grains separated from one another by grain boundaries. The filler also contains electrically conductive particles, which cover at most a part of the surfaces of the spherical particles, and/or the varistor granules contain two fractions of particles with different sizes, of which the particles in the first fraction have larger diameters than the particles in the second fraction and are arranged essentially in the form of close sphere packing and the particles in the second fraction fill the interstices formed by the sphere packing.

The resistor can be produced straightforwardly and cost-effectively and is distinguished by a high nonlinearity coefficient, which is desired for a good protection characteristic, and by a high power acceptance.

20 Claims, No Drawings

NON-LINEAR RESISTANCE WITH VARISTOR BEHAVIOR AND METHOD FOR THE PRODUCTION THEREOF

TECHNICAL FIELD

The invention is based on a nonlinear resistor with varistor behaviour according to the preamble of Patent Claim 1. This resistor contains a matrix and a filler in powder form which is embedded in the matrix. The filler contains sintered varistor granules with predominantly spherical particles of doped metal oxide. The particles are made up of crystalline grains separated from one another by grain boundaries. Since, compared with comparably effective resistors based on sintered ceramic, the elaborate sintering processes can be made substantially simpler, composite resistors of this type can be produced relatively straightforwardly and in a larger variety of shapes. The invention also relates at the same time to a method for the production of this resistor.

PRIOR ART

A resistor of the type mentioned above is described in R. Strümpler, P. Kluge-Weiss and F. Greuter "Smart Varistor Composites", Proceedings of the 8th CIMTECH World Ceramic Congress and Forum on New Materials, Symposium VI (Florence, Jun. 29–Jul. 4, 1994). This resistor consists of a polymer filled with a powder. As the powder, use is made of granules which have been produced by sintering a spray-dried varistor powder based on a zinc oxide doped with oxides of Bi, Sb, Mn, Co, Al and/or other metals. These granules are composed of spherical particles, shaped like a football, which have varistor behaviour and are made up of crystalline grains separated from one another by grain boundaries. The diameters of these particles are up to 300 $\mu$m. By varying the dopants and the sintering conditions, the electrical properties of the sintered granules, such as nonlinearity coefficient $\alpha_B$ and the breakdown field strength $U_B$[V/mm], can be adjusted over a large range. With the same starting materials, a resistor of this type has a higher nonlinearity coefficient and a higher breakdown field strength if the proportion of filler decreases. It has, however, been shown that then, when limiting a voltage, the acceptance capacity for energy is relatively low.

WO 97/26693 describes a composite material based on a polymer matrix and a powder embedded in this matrix. As the powder, granules are used which have likewise been produced by sintering a spray-dried varistor powder based on a zinc oxide doped with oxides of Bi, Sb, Mn, Co, Al and/or other metals. These granules have spherical particles formed in the shape of a football which have varistor behaviour and are made up of crystalline grains separated from one another by grain boundaries. The particles have diameters of at most 125 $\mu$m and have a size distribution which follows a Gaussian distribution. This material is used in cable connections and cable terminations, in which it forms voltage-controlling layers.

U.S. Pat. Nos. 4,726,991, 4,992,333, 5,068,634 and 5,294,374 disclose voltage-limiting resistors made of a polymer and a filler in powder form based on conducting and semiconducting particles. In these resistors, the overvoltage protection is achieved by dielectric breakdown of the polymer. Since relatively high temperatures can occur in this case, the overvoltage protection ought not to be reversible and the energy acceptance capacity ought to be relatively low.

SUMMARY OF THE INVENTION

The object of the invention, as specified in the patent claims, is to provide a resistor which, despite having a high nonlinearity coefficient for a good protection characteristic, is distinguished by a high power acceptance, and at the same time to provide a method with which a resistor of this type can be produced in a particularly advantageous manner.

Through a selection of suitable filler, in the resistor according to the invention electrical properties are achieved which come relatively close to a varistor based on a ceramic. In this case it is essential for either a suitably structured conductive additive filler to be provided and/or for varistor granules to be used which permit a particularly high packing density. It is then possible, using a technique known from injection moulding, extrusion or casting resin technology, to produce resistors in a relatively straightforward way which have varistor behaviour and are distinguished by a good protection characteristic and a high power acceptance. It is particularly advantageous in this case that, through suitable selection of the starting components and through readily adjustable process parameters, it is possible to produce varistors which, in terms of their shaping and their physical properties, have a greatly diversified spectrum and, in particular, a relatively high energy acceptance or switching capacity.

The nonlinear resistor according to the invention may advantageously be used as a field-controlling element in cable fittings or as an overvoltage protection element (varistor). It can be used both in low and in medium and high voltage engineering and, because of its simple production and processability, may without difficulty have a complex geometry. If appropriate, it can, for example as a protection and/or control element, be integrated directly by overmoulding on an electrical device, for example a power circuit breaker, or be applied as a thin coating. It may also be used in screen printing in the hybrid process for integrated circuits.

In the process according to the invention, electrically conductive particles also provided in the filler in addition to the varistor particles are bound to the varistor particles on their surfaces before the filler and matrix material are combined. During the combination, the electrically conductive particles can be relied on not to detach from the surfaces of the varistor particles, so that resistors produced using this process have outstanding electrical properties, and in particular extremely stable current/voltage characteristics.

Particularly good electrical properties are achieved if the loose electrically conductive particles that are still present are removed from the filler, for example by washing, screening or air separation, prior to the combination with the matrix material which is primarily carried out by mixing an infiltration.

A further effect achieved by the process according to the invention is that the electrically conductive particles are distributed uniformly over the surfaces of the varistor particles and enter into atomic bonding with the varistor material. The contact action of the filler is thus very substantially improved and a comparatively small proportion of electrically conductive particles in the filler is sufficient for obtaining resistor with outstanding electrical properties, such as in particular a high current-carrying capacity.

WAY OF IMPLEMENTING THE INVENTION

Nonlinear resistors, designed as varistor composites and having varistor behaviour were produced by mixing polymer material with a filler. Such mixing processes are well-known from the prior art and need not therefore be explained in further detail. The polymers may be thermosets, in particular epoxy or polyester resins, polyurethanes or silicones, or alternatively thermoplastics, for example HDPE, PEEK or ETFE. Instead of the polymer, it is also possible to use a gel (for example silicone gel), a liquid (for example silicone oil, polybutane, ester oil, greases), a gas (air, nitrogen, $SF_6$, etc.), a gas mixture and/or a glass.

All polymers made of liquid components, for example epoxy resins, were premixed and poured over the filler in a vacuum, so that infiltration took place. The infiltrated samples were sometimes then spun, for example in a centrifuge for ½–1 h at 2000 rpm. It was in this way possible to achieve any desired level of filling up to 60%.

Thermoplastic samples were premixed by mixing the filler together with the polymer, for example ETFE, and then pressed in a mould at elevated temperature, for example 280° C., at pressures of many, typically 5–50, bar.

The filler used in this case contained varistor particles of doped metal oxide with predominantly spherical structure, the particles having been made as crystalline grains separated from one another by grain boundaries. The filler was produced as follows:

In a conventional spray-drying process, a varistor mixture, present as an aqueous suspension or solution, of commercially available ZnO, doped with oxides of Bi, Sb, Mn and Co as well as with Ni, Al, Si and/or one or more other metals, was processed to form granules composed of approximately spherical particles. The granules were sintered in a chamber furnace, for example on a ZnO-coated $Al_2O_3$ plate, a Pt sheet or a ZnO ceramic, or if appropriate alternatively in a rotary kiln. The heating rates during sintering were up to 300°/h, typically for example 50° C./h or 80° C./h. The sintering temperature was between 900° C. and 1320° C. The holding time during sintering was between 3 h and 72 h. After sintering, cooling took place at a rate of between 50° C./h and 300° C./h.

The varistor granules produced in this way were then separated in a vibrator or by gentle mechanical friction. By screening, granule fractions with particle sizes of between 90 and 160 μm, 32 and 63 μm and less than 32 μm were then formed from the separated granules.

Varistor granules composed of the various fractions were mixed with one another in specific weight ratios. To some of these mixtures and some of these fractions, a metal powder composed of electrically conductive particles, of geometrically anisotropic, in particular flake-like, form with a thickness to length ratio of typically 1/5 to 1/100 was added, for example Ni flakes whose length was on average less than 60 μm. The length of the metal particles was selected in each case so that it was on average less than the radius of an averagely sized particle in the coarse (90–160 μm) varistor granules. By means of this, and by means of a small proportion, typically from 0.05 to 5 per cent by volume, of the varistor granules the formation of metallically conducting percolation paths in the mixture was avoided.

The starting components of the filler were generally premixed for several hours in a turbine mixer. If one of the starting components was the metal powder, then its particles rested on the surfaces of the spherical varistor particles, so that especially low-resistance contacts were made between the individual varistor particles. Further, smaller particles fall into the interior of the small percentage of varistor particles formed as hollow spheres and thus help to prevent electrical conduction constrictions.

Fine wafers, readily deformable, soft particles and/or short fibres may also be envisaged as the metallic filler. It is advantageous to use a metallic filler with particles which melt close to the maximum processing temperatures, preferentially collect at the contact points of the varistor particles and there lead to improved local contact.

Furthermore, fine powders, for example based on silver, copper, aluminium, gold, indium and their alloys, or conductive oxides, borides, carbides with particle diameters preferably between 1 and 20 μm may also be used as the metallic filler. It is readily possible for the particles of these powders to be of spherical design.

Before the matrix material and the filler are combined, the electrically conductive particles contained in the filler should be bonded to the varistor particles on their surfaces. Then, with a matrix material based on a polymer, such as for example an epoxy resin, the level of conductive electrical particles may then be low and have a lower value of 0.05% by volume.

Such surface bonding can advantageously be achieved by a heat treatment. After mixing of the varistor particles and the electrically conductive particles, these particles do admittedly adhere well to the surfaces of the varistor particles at first. It has, however, been shown that during the subsequent combination, preferably mixing and infiltration, with the matrix material, for example a polymer, a gel or an oil, for example based on a silicone, some of the electrically conductive particles float on the matrix material and then very substantially impair the dielectric strength of a resistor produced in this way. Through processes initiated by the heat treatment, especially diffusion processes, however, the electrically conductive particles become firmly bonded to the surface. During the subsequent combination (mixing, infiltration) with matrix material, floating of the electrically conductive particles on the matrix material is avoided. Even during subsequent mixing and compounding steps, redistribution of the electrically conductive particles cannot take place. These particles which may possibly be present in the heat treated filler may be removed before combination with the matrix material, preferably by washing, screening or air separation. The temperatures needed for the heat treatment are essentially dictated by the material of the electrically conductive particles. The silver, with treatment time of about 3 h, a heat treatment temperature of about 400° C. has been found to be sufficient. Higher temperatures (up to 900° C.) are possible, but it is then necessary to take care that the electrical properties of the varistor particles do not change too greatly. Such changes could, for example, occur owing to a reaction of the material of the electrically conductive particles with the bismuth phase of the varistor particles.

Particularly few detrimental reactions occur if fine solder particles with a low melting point are used as electrically conductive particles, and if the surface bonding produced in this case by adhesion is, if appropriate, also thermally conditioned at low temperatures.

Good surface bonds are also achieved by dispersing powder which contains varistor particles in a metal-containing solution or dispersion, and by producing the surface bonding by wet chemical precipitation of the disperse solution or dispersion or by electrochemical or electrolytic deposition. This bonding can be further reinforced by subsequent heat treatment.

Strong surface bonds between the varistor particles and the electrically conductive particles can also be produced by dispersing a powder which contains varistor particles in a metal-containing solution or dispersion, and by subsequent reactive spray drying or spray pyrolysis of the disperse solution or dispersion. The surface coating from the gas phase is likewise possible, this advantageously being obtained by sputtering, vacuum evaporation or spraying, for example in a fluidized bed or in a powder stream which contains varistor granules and gas.

An advantageous surface coating may also be achieved by frictional contact. In this case, abrasive bodies made of the material [lacuna] the electrically conductive particles are added to the varistor granules, or at least some of them, and/or the electrically conductive particles in a mixer and/or the lining of the mixer contains material of the electrically conductive particles. As an alternative, the surface coating may be obtained by introducing the varistor granules and the electrically conductive particles into a mechano-fusion system, as is for example sold by the company Hosokawa Micron Europe B.V., 2003 RT Haarlem, Holland.

If appropriate, for example if the matrix contains a silicone, it is advantageous to provide at least some of the varistor granules and/or the electrically conductive particles with an adhesion promoter. The bonding of the filler in the matrix is then optimized. Such adhesion promoters are generally applied to the filler in the form of a thin layer. Examples of suitable adhesion promoters include silanes, titanates, zirconates, aluminates and/or chelates. In this case, the electrically conductive particles may also be added to the adhesion promoter and therefore be used together in a way which is of particular economic advantage in the same application process.

Resistor bodies were made, from which sample resistors with a volume of from a few $mm^3$ up to a few $dm^3$ were produced by sawing, grinding and applying two electrodes, for example by coating with a metal such as gold or aluminium. Further, sample bodies were also made in which the electrodes were directly potted during encapsulation with a casting resin, for example an epoxy or a silicone.

The following table gives the compositions of four of these sample resistors, D being the diameter of the particles in the varistor granules.

| Resistor | Polymer | Filler |
|---|---|---|
| 1 | 50 vol % epoxy | 50 vol % varistor granules, D = 90–160 μm |
| 2 | 45 vol % epoxy | 48 vol % varistor granules, D = 90–160 μm<br>7 vol % varistor granules, D = 32–63 μm |
| 3 | 50 vol % epoxy | 47.5 vol % varistor granules, D = 90–160 μm<br>2.5 vol % Ni flakes |
| 4 | 45 vol % epoxy | 48 vol % varistor granules, D = 90–160 μm<br>5.5 vol % varistor granules, D = 32–63 μm<br>1.5 vol % Ni flakes |

All these resistors were made from the same starting polymer and the same coarse starting granules (D=90–160 μm).

Resistor 1 corresponded to the prior art.

In comparison with resistor 1, resistor 2 had a higher filler density and, in addition, a proportion, amounting to about 15 vol % of the coarse starting granules, of the above-described fine-grained varistor granules (D=32–63 μm).

In comparison with resistors 1 and 2, resistor 3 had a proportion, amounting to 5 vol % of the filler, of electrically conducting Ni flakes.

In comparison with resistors 1 to 3, resistor 4 had both a proportion, amounting to about 10 vol % of the filler, of the fine-grain varistor granules and a proportion, amounting to about 3 vol %, of electrically conducting Ni flakes.

For these four resistors, as can be seen from the table below, the breakdown field strength $U_B$[V/mm], the nonlinearity coefficient $\alpha_B$ and the maximum accepted power P[J/$cm^3$] were measured.

In order to determine $U_B$ and $\alpha$, a variable DC voltage was applied to the resistors and the resistors were thus exposed to electric field strengths of between about 5 and about 500 [V/mm]. As a function of the prevailing field strength, the current density J[A/$cm^2$] flowing through each of the resistors was measures. The values of U and J measured in this way determined the current/voltage characteristics of the resistors. From each of the characteristics, the breakdown field strength $U_B$ of the associated resistor at a current density of $1.3\times10^{-4}$[A/$cm^2$] was established. $\alpha_B$ was taken on a double-logarithmic scale for each of the resistors from the slope of the tangent to the associated current/voltage characteristic at the point determined by the breakdown field strength $U_B$.

P was established from a current pulse test, in which the resistors were exposed in a test device to several 8/20 μs current pulses with current density amplitudes of up to 1[kA/$cm^2$] at electric field strengths of up to 800[V/mm].

| Sample | $U_B$[V/mm] | $\alpha_B$ | P[J/$cm^3$] |
|---|---|---|---|
| 1 | 321 | 16.7 | 23.8 |
| 2 | 239 | 28.8 | 38.2 |
| 3 | 150.8 | 24.7 | 74.6 |
| 4 | 176.1 | 20.6 | 109.6 |

It can be seen from this table that, compared with the resistor according to the prior art (resistor 1), resistors 2 to 4 are distinguished both by a higher nonlinearity coefficient $\alpha_B$ and by an increased power acceptance P, at a simultaneously low breakdown field strength $U_B$. This is on the one hand a consequence of the improved contact between the individual varistor particles by virtue of the electrically conductive particles, which were additionally contained in the mixture and, on the other hand, a consequence of an especially high density of varistor particles. This high density results from varistor granules containing two fractions of particles with different sizes, of which the particles in the first fraction have larger diameters than the particles in the second fraction and are arranged essentially in the form of close sphere packing and the particles in the second fraction fill the interstices formed by the sphere packing.

The diameters of the particles in the first fraction are preferably from about 40 to about 200 μm. In order to achieve a high density, it is particularly favourable if the diameters of the particles in the second fraction are about 10 to about 50% of the diameters of the particles in the first fraction, and if the quantity of the second fraction is from about 5 to about 30% by volume of the amount of the first fraction.

It has been shown that an improved energy acceptance is achieved if at least one further fraction of predominantly spherically formed particles is present, whose diameters are from about 10 to about 50% of the diameters of the particles in the second fraction, and which for example contains particles smaller than 32 μm the power consumption and/or other properties can be further improved by special stoichiometric compositions and by particular structures of the individual fractions, by selection of suitable electrically conductive particles and by use of specific conditions in the preparation of the fractions, for example during sintering.

What is claimed is:

1. Nonlinear resistor with varistor behaviour, comprising:

two electrodes; and a resistor body between the two electrodes, the resistor body containing a matrix and a filler in powder form and embedded in the matrix, wherein the filler comprises sintered varistor granules with predominantly spherical particles of doped metal oxide, wherein the predominantly spherical particles are made of crystalline grains separated from one another by boundaries, and wherein the filler further comprises electrically conductive particles fused to the surfaces of the predominantly spherical particles, the electrically conductive particles forming direct electrical low-resistance contacts between the predominantly spherical particles.

2. Resistor according to claim 1, wherein the electrically conductive particles provided in the filler make up from about 0.05% to about 5% by volume of the filler.

3. Resistor according to claim 2, wherein at the electrically conductive particles are of geometrically anisotropic design.

4. Resistor according to claim 3, wherein at least a portion of the electrically conductive particles is in wafer and/or flake form and these wafers and/or flakes have a thickness to height ratio of from about 1/5 to 1/100.

5. Resistor according to claim 4, wherein the length of the wafers and/or flakes is on average less than a radius of at least a portion of the predominantly spherical particles.

6. Resistor according to claim 3, wherein at least a portion of the electrically conductive particles is formed by short fibers.

7. Resistor according to claim 1, wherein at least a portion of the varistor granules and/or the electrically conductive particles is provided with an adhesion promoter.

8. Resistor according to claim 1, wherein the varistor granules contain at least two fractions of particles with different sizes, of which the particles in the first fraction have larger diameters than the particles in the second fraction and are arranged essentially in the form of close sphere packing and the particles in the second fraction fill the interstices formed by the sphere packing.

9. Resistor according to claim 8, wherein the diameters of the particles in the second fraction are from about 10 to about 50% of the diameters of the particles in the first fraction.

10. Resistor according to claim 9, wherein the diameters of the particles in the first fraction are from about 40 to about 200 $\mu$m.

11. Resistor according to claim 8, wherein the quantity of the second fraction is from about 5 to about 30% by volume of the amount of the first fraction.

12. Resistor according to claim 8, wherein at least one further fraction of predominantly spherically formed particles is present, whose diameters are from about 10 to about 50% of the diameters of the particles in the second fraction.

13. Process for the production of a resistor according to claim 1, in which the filler, which is in powder form and contains the varistor particles and the electrically conductive particles, is combined with a material forming the matrix, wherein before the combination the electrically conductive particles contained in the filler are bonded to the varistor particles on their surfaces.

14. Process according to claim 13, wherein the electrically conductive particles are combined by mixing with a powder which contains the varistor particles and in that the mixture formed in this way is heat treated at temperatures at which the surface bond is formed.

15. Process according to claim 14, wherein solder particles are used as the electrically conductive particles.

16. Process according to claim 14, wherein electrically conductive particles that are not surface-bound are removed from the heat-treated mixture.

17. Process according to claim 13, wherein a powder which contains varistor particles is dispersed in a metal-containing solution or dispersion, and in that by wet chemical precipitation of the disperse solution or dispersion or by electrolytic or electrochemical deposition, the electrically conductive particles bonded to the surfaces of the varistor particles are produced as a precipitation or deposition product.

18. Process according to claim 17, wherein the precipitation product is heat treated.

19. Process according to claim 13, wherein a powder which contains varistor particles is dispersed in a metal-containing solution or dispersion, and in that the electrically conductive particles bonded to the surfaces of the varistor particles are produced by reactive spray drying or spray pyrolysis of the disperse solution or dispersion.

20. Process according to claim 18, wherein the electrically conductive particles that are not surface-bound are removed from the heat-treated mixture by washing, screening or air separation.

* * * * *